US011753893B2

(12) United States Patent
Irsa

(10) Patent No.: US 11,753,893 B2
(45) Date of Patent: Sep. 12, 2023

(54) HIGH RATIO REAMER

(71) Applicant: Schlumberger Technology Corporation, Sugar Land, TX (US)

(72) Inventor: Juraj Irsa, Houston, TX (US)

(73) Assignee: SCHLUMBERGER TECHNOLOGY CORPORATION, Sugar Land, TX (US)

( * ) Notice: Subject to any disclaimer, the term of this patent is extended or adjusted under 35 U.S.C. 154(b) by 0 days.

(21) Appl. No.: 18/148,501

(22) Filed: Dec. 30, 2022

(65) Prior Publication Data

US 2023/0147178 A1 May 11, 2023

Related U.S. Application Data

(63) Continuation of application No. 17/067,984, filed on Oct. 12, 2020, now Pat. No. 11,542,769.

(60) Provisional application No. 62/914,004, filed on Oct. 11, 2019.

(51) Int. Cl.

| | |
|---|---|
| ***E21B 29/08*** | (2006.01) |
| ***E21B 17/18*** | (2006.01) |
| ***E21B 10/32*** | (2006.01) |

(52) U.S. Cl.
CPC ..... *E21B 29/08* (2013.01); *E21B 10/322* (2013.01); *E21B 17/18* (2013.01)

(58) Field of Classification Search
CPC ..... E21B 10/26; E21B 10/32; E21B 10/322
See application file for complete search history.

(56) References Cited

U.S. PATENT DOCUMENTS

| | | | | |
|---|---|---|---|---|
| 4,433,738 | A * | 2/1984 | Moreland | E21B 10/30 175/406 |
| 9,915,100 | B2 * | 3/2018 | Mahajan | E21B 10/265 |
| 9,915,101 | B2 | 3/2018 | Mahajan et al. | |
| 2009/0145666 | A1 | 6/2009 | Radford et al. | |
| 2009/0277689 | A1 * | 11/2009 | Lee | E21B 23/042 175/269 |
| 2010/0288557 | A1 | 11/2010 | Radford | |
| 2011/0220357 | A1 * | 9/2011 | Segura | E21B 29/005 166/55.3 |
| 2014/0182940 | A1 * | 7/2014 | Mahajan | E21B 10/322 175/57 |

(Continued)

FOREIGN PATENT DOCUMENTS

| | | | |
|---|---|---|---|
| WO | 03102354 | A1 | 12/2003 |
| WO | 2008070038 | B1 | 7/2008 |

OTHER PUBLICATIONS

International Search Report and Written Opinion issued in International Patent Application No. PCT/US2020/055193 dated Feb. 26, 2021, 8 pages.

(Continued)

*Primary Examiner* — David Carroll
(74) *Attorney, Agent, or Firm* — Jeffrey D. Frantz

(57) ABSTRACT

A reamer includes a housing, a flow tube extending along a longitudinal axis of the housing, and a plurality of reamer blocks arranged radially around the flow tube and configured to extend and retract relative to the housing. The reamer has a reamer ratio between 1.8 and 2.5. The reamer ratio is a ratio between an expanded diameter of the reamer when the plurality of reamer blocks is extended and a retracted diameter of the reamer when the plurality of reamer blocks is retracted.

19 Claims, 10 Drawing Sheets

(56) References Cited

U.S. PATENT DOCUMENTS

| | | | |
|---|---|---|---|
| 2016/0017664 | A1 | 1/2016 | Barnhouse et al. |
| 2021/0108477 | A1 | 4/2021 | Irsa |

OTHER PUBLICATIONS

International Preliminary Report on Patentability issued in PCT Application No. PCT/US2020/055193 dated Apr. 21, 2022.
Merriam-Webster Nest https://www.merriam-webster.com/dictionary/nested (Year: 2022).

* cited by examiner

HIGH RATIO REAMER

CROSS-REFERENCE TO RELATED APPLICATIONS

This application is a continuation application of U.S. patent application Ser. No. 17/067,984 filed on Oct. 12, 2020, which claims the benefit of, and priority to, U.S. Patent Application No. 62/914,004 filed on Oct. 11, 2019, which are each incorporated herein by this reference in their entirety.

BACKGROUND OF THE DISCLOSURE

Wellbores may be drilled into a surface location or seabed for a variety of exploratory or extraction purposes. For example, a wellbore may be drilled to access fluids, such as liquid and gaseous hydrocarbons, stored in subterranean formations and to extract the fluids from the formations. Wellbores used to produce or extract fluids may be lined with casing around the walls of the wellbore. A variety of drilling methods may be utilized depending partly on the characteristics of the formation through which the wellbore is drilled.

A wellbore may be initially drilled with a first diameter. A portion of the wellbore may be expanded using a reamer. In some embodiments, the reamer may be located uphole of the bit in the same bottom hole assembly. In some embodiments, the reamer may increase the diameter of the wellbore after a pilot hole has been drilled. Some reamers may include reamer blocks that may be selectively expanded to increase the diameter of the wellbore.

SUMMARY

In some embodiments, A reamer includes a housing, a flow tube extending along a longitudinal axis of the housing, and a plurality of reamer blocks arranged radially around the flow tube and configured to extend and retract relative to the housing. The reamer has a reamer ratio between 1.8 and 2.5. The reamer ratio is a ratio between an expanded diameter of the reamer when the plurality of reamer blocks is extended and a retracted diameter of the reamer when the plurality of reamer blocks is retracted.

In other embodiments, a reamer includes a housing, a flow tube, and a reamer block. The housing includes a body around a longitudinal axis and defining an interior passage. The flow tube extends through the interior passage of the housing. The reamer block is configured to extend and retract relative to the housing. The reamer block includes a block transverse axis offset from the longitudinal axis, a leading wall, and a radial perimeter. A coverage-to-exposure ratio is less than or equal to 1.00. An exposure is a distance on the leading wall from the outer surface of the housing to the radial perimeter when the reamer block is extended. A coverage is a length of a contact of the leading wall with the housing when the reamer block is extended.

This summary is provided to introduce a selection of concepts that are further described in the detailed description. This summary is not intended to identify key or essential features of the claimed subject matter, nor is it intended to be used as an aid in limiting the scope of the claimed subject matter. Additional features and aspects of embodiments of the disclosure will be set forth herein, and in part will be obvious from the description, or may be learned by the practice of such embodiments.

BRIEF DESCRIPTION OF THE DRAWINGS

In order to describe the manner in which the above-recited and other features of the disclosure can be obtained, a more particular description will be rendered by reference to specific embodiments thereof which are illustrated in the appended drawings. For better understanding, the like elements have been designated by like reference numbers throughout the various accompanying figures. While some of the drawings may be schematic or exaggerated representations of concepts, at least some of the drawings may be drawn to scale. Understanding that the drawings depict some example embodiments, the embodiments will be described and explained with additional specificity and detail through the use of the accompanying drawings in which:

FIG. 2-1 is a perspective view of a reamer in an expanded configuration, according to at least one embodiment of the present disclosure;

FIG. 2-2 is a longitudinal cross-sectional view of the reamer of FIG. 2-1 in a retracted configuration;

FIG. 2-3 is a longitudinal cross-sectional view of the reamer of FIG. 2-1 in an expanded configuration;

FIG. 2-4 is a transverse cross-sectional view of the reamer of FIG. 2-1 in a retracted configuration;

FIG. 2-5 is a transverse cross-sectional view of the reamer of FIG. 2-1 in an expanded configuration;

FIG. 3 perspective view of a reamer block, according to at least one embodiment of the present disclosure;

FIG. 4-1 is a transverse cross-sectional view of a reamer in a retracted configuration, according to at least one embodiment of the present disclosure;

FIG. 4-2 is a transverse cross-sectional view of the reamer of FIG. 4-1 in an expanded configuration; and FIG. 5 cut-away view of a reamer, according to at least one embodiment of the present disclosure.

DETAILED DESCRIPTION

Figure 1:
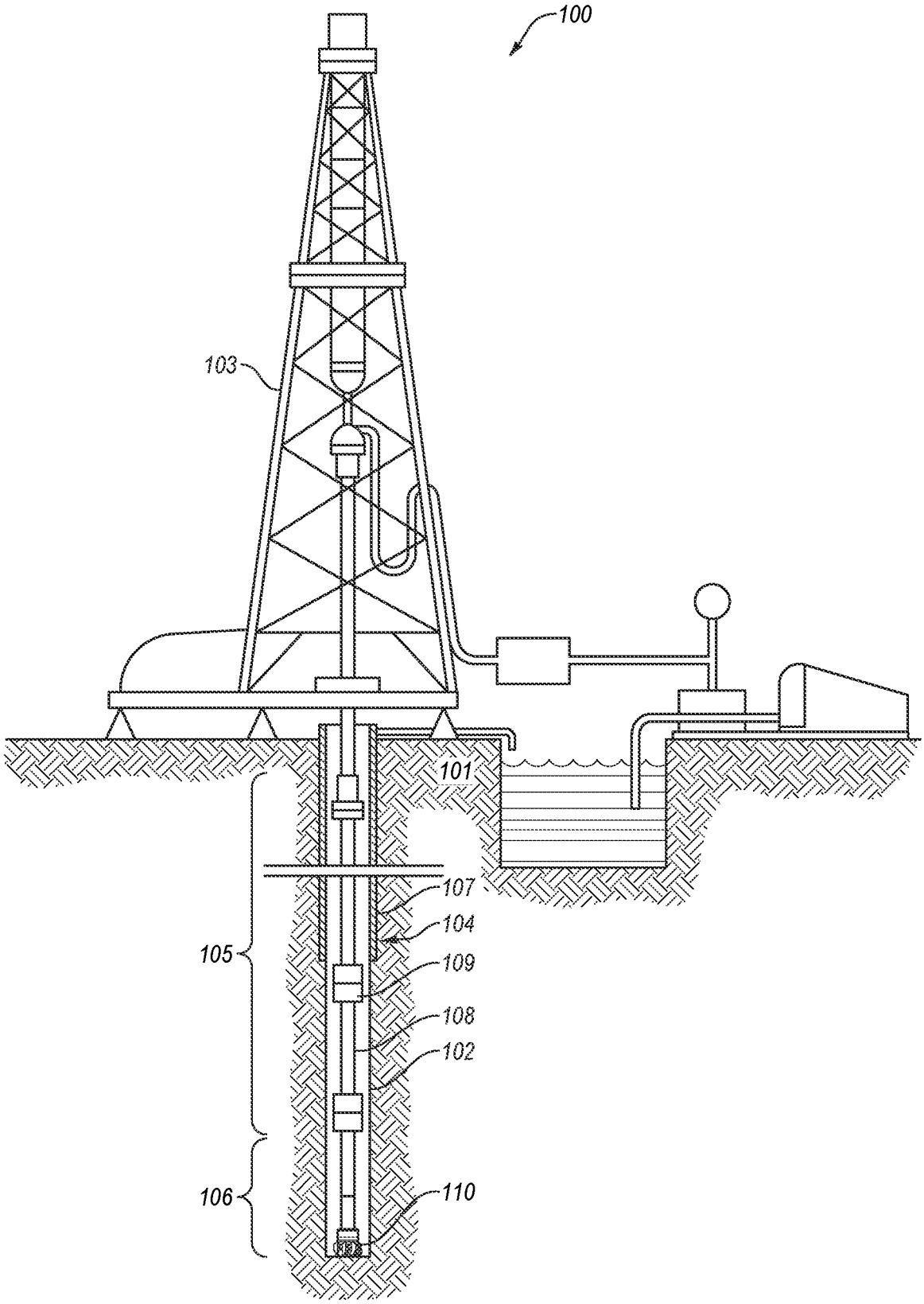
FIG. 1 is representation of a drilling system, according to at least one embodiment of the present disclosure.

This disclosure generally relates to devices, systems, and methods for high ratio expandable reamers. In some embodiments, the reamer blocks of a reamer may have an interior surface that may be nested in a portion of a circumferentially adjacent reamer block. This may allow the reamer blocks to have a higher exposure, which may increase the diameter of the reamed hole. This may allow larger holes to be drilled, thereby potentially preventing further trips downhole with another reamer, allowing larger tools and fluid flows to be used in the wellbore.

In some embodiments, the reamer blocks of a reamer may have an interior surface that may be nested in a portion of a circumferentially adjacent reamer block. This may allow the reamer blocks to have a higher height. This interior surface may allow the reamer block to close to a smaller diameter, allowing to trip through a tighter restriction in the wellbore.

In downhole drilling operations, reamers may be used to increase the diameter of a wellbore. In some embodiments, a reamer may be located on the same BHA as a bit. In this manner, as the bit erodes a formation with a bit diameter, the reamer may follow the bit and erode the formation with a reamer diameter. This may allow for larger wellbores to be drilled in a single pass or trip downhole. In other words, the pilot hole may be drilled immediately while reaming the wellbore. In some embodiments, a reamer may be tripped into an existing wellbore, to increase the diameter of the existing wellbore in a different pass or trip than the bit. In other words, a pilot hole may be drilled before the reamer is inserted into the wellbore.

A plurality of reamer blocks may extend from a housing to erode the formation. In some embodiments, a reamer may be an expandable reamer. An expandable reamer may have an expanded configuration and a retracted configuration. In the retracted configuration, a cutting surface of the reamer blocks is located radially inward from an outer surface of the housing. In this manner, as the reamer is tripped into a wellbore, the reamer blocks may not contact and erode portions of the wellbore wall. In the expanded configuration, the reamer blocks are radially extended out of the housing so that the cutting surface is located radially outward from the housing. In this manner, as the reamer is rotated, the reamer may erode portions of the wellbore wall and expand the diameter along portions of the wellbore.

The reamer may be expanded using any expansion force. For example, the reamer may be expanded using a hydraulic pressure differential between an interior of the housing and an exterior of the housing. A flow tube may flow through the housing and past the reamers. The flow tube may include one or more ports into a piston chamber. A piston may be longitudinally movable and connected to the piston chamber. As the pressure from the drilling fluid on the piston increases, the piston may move longitudinally. The piston may push on the reamer blocks, which may slide on rails. The rails may be angled radially outward such that as the piston moves the reamer blocks longitudinally, the reamer blocks may move radially outward into the expanded configuration. A resilient member may push against the reamer blocks with a resilient force that opposes the force applied by the piston. Thus, when the hydraulic pressure on the piston overcomes the resilient force, the reamer blocks may be moved outward to the expanded configuration. In this manner, the reamer may be a hydraulically activated reamer. In other words, to activate the reamer, the pressure of the drilling fluid passing through the flow tube may be increased.

The reamer has an expanded diameter (e.g., the diameter of a circle circumscribed about the outer wall of the reamer blocks in the expanded configuration) and a retracted diameter (e.g., the diameter of a circle circumscribed about the outer surface of the housing in the retracted configuration). The reamer ratio is the ratio between the expanded diameter and the retracted diameter. In some embodiments, the reamer ratio may be in a range having an upper value, a lower value, or upper and lower values including any of 2.5, 2.4, 2.3, 2.2, 2.1, 2.0, 1.9, 1.8, 1.7, 1.6, 1.5, 1.4, 1.3, 1.2, 1.1, or any value therebetween. For example, the reamer ratio may be greater than 1.1. In another example, the reamer ratio may be less than 2.5. In yet other examples, the reamer ratio may be any value in a range between 1.1 and 2.5. In some embodiments, it may be critical that the reamer ratio is greater than 2.0 to sufficiently expand the wellbore diameter.

The reamer blocks extend from the housing so that the cutting elements on a reamer block are located a distance away from the housing. This distance may be the exposure of the reamer. In other words, the exposure may be half of the difference in the expanded diameter of the reamer compared to the retracted diameter of the reamer.

A reamer block has an outer surface, a leading wall, a trailing wall, and an interior wall. The outer wall includes one or more cutting elements. The leading wall is the lateral side face of the reamer block that faces the direction of rotation (e.g., the lateral side face that engages the formation first while rotating). The trailing wall is the lateral face of the reamer block that faces opposite the direction of rotation. The leading wall and the trailing wall engage the guides in the housing to direct the reamer block radially outward. The interior wall is opposite the outer wall, and is adjacent to both the leading wall and the trailing wall.

During rotating of the reamer, the leading edge of the reamer block may engage the formation. This may push the reamer block against the trailing edge of the opening in the housing through which the reamer block is extended. Because the outer wall is extended past the housing, the reamer block may tend to rotate based on the offset forces from the cutting elements at the outer wall and the trailing edge of the opening. The rotation of the reamer block may be prevented by contact with the leading wall on the leading edge of the opening. The radial extent of the contact of the leading wall on the leading edge of the opening is the coverage of the reamer block.

A ratio of the coverage to the exposure is the coverage-to-exposure ratio. The coverage-to-exposure ratio is an indication of the maximum extension of the reamer. In some embodiments, the coverage-to-exposure ratio may be in a range having an upper value, a lower value, or upper and lower values including any of 0.50, 0.60, 0.70, 0.75, 0.80, 0.85, 0.90, 0.95, 1.00, 1.05, 1.10, 1.1, 1.2, 1.3, 1.4, 1.5, 1.6, 1.7, 1.8, 1.9, 2.0, or any value therebetween. For example, the coverage-to-exposure ratio may be greater than 0.50. In another example, the coverage-to-exposure ratio may be less than 2.0. In yet other examples, the coverage-to-exposure ratio may be any value in a range between 0.50 and 2.0. In some embodiments, it may be critical that the coverage-to-exposure ratio is less than 1.00 to sufficiently increase the diameter of the wellbore. A lower coverage-to-exposure ratio is in indication that the reamer may have a larger increase in the diameter of the wellbore. In some embodiments, each reamer block may have the same coverage-to-exposure ratio. In some embodiments, different reamer blocks may have different coverage-to-exposure ratios.

In some embodiments, the exposure may be in a range having an upper value, a lower value, or upper and lower values including any of 1.5 in. (3.8 cm), 1.6 in. (4.1 cm), 1.7 in. (4.3 cm), 1.8 in. (4.6 cm), 1.9 in. (4.8 cm), 2.0 in. (5.1 cm), 2.1 in. (5.3 cm), 2.2 in. (5.6 cm), 2.3 in. (5.8 cm), 2.4 in. (6.1 cm), 2.5 in. (6.4 cm), 3.0 in. (7.62 cm), 4.0 in. (10.16 cm), 5.0 in. (12.7 cm), 6.0 in. (15.24 cm), 8.0 in. (20.32 cm), 10.0 in. (25.40 cm), 12.0 in. (30.48 cm), 15.0 in. (38.10 cm), 18.5 cm (46.99 cm), or any value therebetween. For example, the exposure may be greater than 1.5 in (3.8 cm). In another example, the exposure may be less than 18.5 cm (46.99 cm). In yet other examples, the exposure may be any value in a range between 1.5 in (3.8 cm) and 18.5 cm (46.99 cm). In some embodiments, it may be critical that the exposure be greater than 2.0 in. (5.1 cm) to sufficiently increase the diameter of the wellbore. In some embodiments, each reamer block may have the same exposure. In some embodiments, different reamer blocks may have different exposures.

In some embodiments, the coverage may be in a range having an upper value, a lower value, or upper and lower values including any of 1.0 in. (2.5 cm), 1.5 in. (3.8 cm), 1.6 in. (4.1 cm), 1.7 in. (4.3 cm), 1.8 in. (4.6 cm), 1.9 in. (4.8 cm), 2.0 in. (5.1 cm), 2.1 in. (5.3 cm), 2.2 in. (5.6 cm), 2.3 in. (5.8 cm), 2.4 in. (6.1 cm), 2.5 in. (6.4 cm), 3.0 in. (7.62 cm), 4.0 in. (10.16 cm), 5.0 in. (12.7 cm), 6.0 in. (15.24 cm), 8.0 in. (20.32 cm), 10.0 in. (25.40 cm), or any value therebetween. For example, the coverage may be greater than 1.0 in (2.5 cm). In another example, the coverage may be less than 10.0 (25.4 cm). In yet other examples, the coverage may be any value in a range between 1.0 in (2.5 cm) and 10.0 in. (25.4 cm). In some embodiments, it may be critical that the coverage be greater than 1.8 in. (4.6 cm) to provide support for the reamer block. Increased coverage may result in greater stability for the reamer block. Furthermore, increased coverage may increase the strength of reamer, thereby reducing the chance of the reamer block breaking during reaming operations. In some embodiments, each reamer block may have the same coverage. In some embodiments, different reamer blocks may have different coverages.

The leading wall has a leading wall height which is the distance from the outer wall to the inner wall along the leading wall. In some embodiments, the leading wall height is the sum of the exposure and the coverage. In some embodiments, the leading wall height is greater than the sum of the exposure and the coverage. The trailing wall has a trailing wall height, which is the distance from the outer wall to the inner wall along the trailing wall. In some embodiments, the leading wall height is greater than the trailing wall height. This may allow for the leading wall to have an increased coverage against a leading edge of the opening in the housing and/or for the reamer block to extend further from the housing. This may increase the stability and/or strength of the reamer block during reaming. The ratio of the leading wall height to the trailing wall height is the wall-height ratio. In some embodiments, the wall-height ratio may be in a range having an upper value, a lower value, or upper and lower values including any of 1.0, 1.1, 1.2, 1.3, 1.4, 1.5, 1.6, 1.7, 1.8, 1.9, 2.0, 2.5, 3.0, or any value therebetween. For example, the wall-height ratio may be greater than 1.0. In another example, the wall-height ratio may be less than 3.0. In yet other examples, the wall-height ratio may be any value in a range between 1.0 and 3.0. In some embodiments, it may be critical that the wall-height ratio is greater than 1.2 to increase the coverage and exposure of the reamer block. Furthermore, a wall-height ratio greater than 1.2 may allow circumferentially adjacent reamer blocks to further nest into each other. In some embodiments, each reamer block may have the same wall-height ratio. In some embodiments, different reamer-blocks may have different wall-height ratios.

In some embodiments, the leading wall height may be greater than a radius of the housing. In other words, the leading wall height may be greater than half of the retracted diameter. The leading wall has a height-to-retracted-diameter ratio. In some embodiments, the height-to-retracted-diameter ratio may be in a range having an upper value, a lower value, or upper and lower values including any of 0.45, 0.5, 0.55, 0.6, 0.65, 0.70, 0.75, or any value therebetween. For example, the height-to-retracted-diameter ratio may be greater than 0.45. In another example, the height-to-retracted-diameter ratio may be less than 0.075. In yet other examples, the height-to-retracted-diameter ratio may be any value in a range between 0.45 and 0.75. In some embodiments, it may be critical that the height-to-retracted-diameter ratio is greater than 0.5 to increase the exposure and decrease the coverage-to-exposure ratio. In some embodiments, each reamer block may have the same height-to-retracted-diameter ratio. In some embodiments, different reamer blocks may have different height-to-retracted-diameter ratios.

In some embodiments, the body of the reamer block includes a recess in the trailing wall. The inner edge of the leading wall may be sized and configured to be inserted into the recess. In this manner, the leading wall of a first reamer block may be nested into the trailing wall of an adjacent reamer block. This may allow the reamer block to be withdrawn further into the interior of the housing, thereby allowing for an increased exposure, and a decreased coverage-to-exposure ratio. In some embodiments, the recess is located at the intersection between the inner wall and the trailing wall. In other words, the corner between the inner wall and the trailing wall may be fully or partially removed to create the recess.

For example, a first reamer block has a first leading wall and a first trailing wall. The first leading wall may have a first leading wall height that is larger than a first trailing wall height. The first trailing wall may include a first recess. A second reamer block has a second leading wall and a second trailing wall. The second reamer block may be circumferentially adjacent (e.g., located as the next reamer block following the circumference of the reamer) to the first reamer block in the direction of rotation. The second trailing wall may include a second recess. The first leading wall (e.g., an inner edge of the first leading wall) may be inserted into the second recess in the retracted position. Similarly, a third reamer block may include a third leading wall and a third trailing wall. The third reamer block may be circumferentially adjacent to the second reamer block in the direction of rotation, and the first reamer block may be circumferentially adjacent to the second reamer block in the direction of rotation. The third trailing wall may include a third recess. The second leading wall of the second reamer block may be inserted into the third recess. Similarly, the third leading wall of the third reamer block may be inserted into the first recess. Thus, the reamer blocks of the reamer may be nested into circumferentially adjacent reamer blocks. In this manner, the reamer blocks may be retracted further into the interior of the housing. This may increase the exposure and allow for a decreased coverage-to-exposure ratio of each reamer block, resulting in a larger increase in wellbore diameter reamed by the reamer.

In some embodiments, as discussed above, the reamer may include three reamer blocks. In some embodiments, the reamer may include more or less than three reamer blocks. For example, the reamer may include two, three, four, five, six, or more reamer blocks. Regardless of the number of reamer blocks, each reamer block of a reamer may include a recess, and the leading wall of a circumferentially adjacent reamer block may extend into the recess of the trailing wall of the circumferentially adjacent reamer block.

In some embodiments, the recess may extend an entirety of the length of the reamer block. In some embodiments, the recess may extend less than the entirety of the length of the reamer block. One or both of the leading wall and the trailing wall of the reamer block may include a sliding ramp. As the reamer block moves between the expanded and the retracted configuration, the reamer block may slide along the sliding ramp. The recess may extend along the trailing wall only for the length that the bottom edge of the leading wall extends until it reaches the sliding ramp. In some embodiments, the recess may begin between the upper end and the lower end of the reamer block. This may allow the outer wall to extend all the way to the upper end of the reamer block.

In some embodiments, the recess has a recess depth into the body of the reamer block. This may be visualized as the extent into which the leading wall of the circumferentially adjacent reamer block extends into the body of the reamer block. The recess depth may be recess percentage of the reamer body width. In some embodiments, the recess percentage may be greater than 5%, greater than 10%, greater than 15%, greater than 20%, greater than 25%, greater than 30%, greater than 35%, greater than 40%, greater than 45%, greater than 50%, or any value therebetween. In some embodiments, it may be critical that the recess percentage is greater than 10% to allow circumferentially adjacent reamer blocks to nest with each other. In some embodiments, each reamer block may have the same recess percentage. In some embodiments, different reamer blocks may have different recess percentages.

In some embodiments, the interior wall may include a surface that is not flat. For example, the interior wall may include a rounded surface. In some embodiments, the interior wall may have a shape that is complementary or partially complementary to the flow tube. For example, the flow tube may have a circular cross-sectional shape, and the interior wall may have a circular or partially circular cross-sectional shape. The interior wall may include a circular cross-sectional shape. In some embodiments, the interior wall may be complementary to the flow tube for a wall arc angle. In some embodiments, the wall arc angle may be in a range having an upper value, a lower value, or upper and lower values including any of 45°, 60°, 75°, 80°, 85°, 90°, 95°, 100°, 105°, 120°, or any value therebetween. For example, the wall arc angle may be greater than 45°. In another example, the wall arc angle may be less than 120°. In yet other examples, the wall arc angle may be any value in a range between 45° and 120°. In some embodiments, it may be critical that the wall arc angle is greater than 90° to nest the interior wall against the flow tube, increase the exposure, and decrease the coverage-to-exposure ratio. In some embodiments, in the retracted position, the interior wall of the reamer block may contact or envelop a portion of the flow tube in the retracted position. In some embodiments, the interior wall of the reamer block may be slightly or moderately offset from the flow tube. In some embodiments, the interior wall is concave, or at least a portion of the interior wall is concave. In some embodiments, the interior walls of all of the reamer blocks may envelop (e.g., encompass, contact, cover) all or approximately (e.g., nearly) all of an outer circumference of the flow tube. In other words, the sum of all the wall arc angles for the first reamer block, the second reamer block, and the third reamer block may equal 360°.

In some embodiments, the flow tube may extend through a center of the housing. In some embodiments, the flow tube may be coaxial (e.g., have the same longitudinal axis) with the housing. Thus, each reamer block may have the same wall arc angle. In some embodiments, different reamer blocks may have different wall arc angles.

In some embodiments, a line drawn through the longitudinal axis and perpendicular to the longitudinal axis of the housing may contact two or more reamer blocks in the retracted configuration. In some embodiments, a line drawn through the longitudinal axis of the housing may contact all three reamer blocks. For example, the line drawn through the longitudinal axis may be parallel to a block transverse axis. This line may contact a first reamer block in the body of the first reamer block, the second reamer block in the inner edge of the leading wall, and the third reamer block in the recess of the trailing wall.

The reamer block has a reamer block transverse axis, which is the axis between the outer wall and the inner wall. In some embodiments, the block transverse axis of one or more reamer blocks may extend through the longitudinal axis of the housing. In some embodiments, the block transverse axis of one or more reamer blocks may be offset from the longitudinal axis of the housing. In some embodiments, the block transverse axis of one or more reamer blocks may be offset from the longitudinal axis of the housing in the rotational direction of the reamer. In some embodiments, the block transverse axis of one or more reamer blocks may be offset from the longitudinal axis of the housing opposite the rotational direction of the reamer. Offsetting the block transverse axis may allow the reamer blocks to nest deeper with respect to each other, thereby allowing the reamer blocks to have an increased exposure and/or a lower coverage-to-exposure ratio.

In some embodiments, the block transverse axis may be offset from the longitudinal axis of the reamer with an offset percentage, which is the length of the offset with respect to the diameter of the housing. In some embodiments, the offset percentage may be in a range having an upper value, a lower value, or upper and lower values including any of 1%, 2.5%, 5%, 7.5%, 10%, 12.5%, 15%, 20%, 25%, or any value therebetween. For example, the offset percentage may be greater than 1%. In another example, the offset percentage may be less than 25%. In yet other examples, the offset percentage may be any value in a range between 1% and 25%. In some embodiments it may be critical that the offset percentage is greater than 1% to increase the exposure and/or decrease the coverage-to-exposure ratio. In some embodiments, each reamer block may have the same offset percentage. In some embodiments, different reamer blocks may have different offset percentages.

In some embodiments, the reamer may include one or more secondary flow tubes. The secondary flow tubes may be located in the interior of the housing between two circumferentially adjacent reamer blocks. The housing may include an outer space defined by the leading wall of a first reamer block, a trailing wall of a second reamer block, and the interior wall of the housing when the reamer is in the retracted configuration. A flow tube may be located in the outer space and extend along the length of the reamer blocks. Adding a flow tube to the outer space may increase the flow area for a fluid to flow through. This may increase the volumetric flow rate of the fluid flow for a given fluid pressure. This may allow different downhole tools to be used in conjunction with the reamer, thereby improving the versatility of the reamer.

In some embodiments, a resilient member may be arranged around one or more of the secondary flow tubes to provide the resilient force that opposes the engagement force by the piston. Thus, when the hydraulic pressure pushes on the piston, which pushes on the reamer blocks with an engagement force, thereby urging them to move longitudinally. This engagement force is resisted by the resilient force of the resilient members. Thus, when the engagement force overcomes the resilient force, the reamer blocks are urged longitudinally. As the reamer blocks move longitudinally, rails on the opening in the housing direct the reamer blocks radially outward.

In some embodiments, the resilient member is a coil spring coiled around the secondary flow tubes. In some embodiments, each secondary flow tube includes a resilient member. In some embodiments, not all of the secondary flow tubes include a resilient member. For example, in some embodiments one or two (out of three) secondary flow tubes may include a resilient member.

Drilling fluid flowing through housing may be directed into the flow tube and secondary flow tubes with a flow diverter. The flow diverter may divert flow into the flow tubes. For example, the flow diverter may include a primary port. The primary port may be in fluid communication with the primary flow tube. In some examples, the flow diverter may include one or more secondary ports in fluid communication with the secondary flow tubes. Thus, as fluid flow flows through the housing, the flow diverter may divert flow into the primary flow tube through the primary port and into the secondary flow tubes through the secondary ports.

In some embodiments, an uphole end of the flow diverter extends uphole. This may allow the flow diverter to have a reduced flow diversion angle. A low flow diversion angle may reduce wear on the flow diverter from high velocity fluid flow and particulates in the fluid flow. In some embodiments, the flow diversion angle may be in a range having an upper value, a lower value, or upper and lower values including any of 0.5°, 1.0°, 1.5°, 2.0°, 2.5°, 3.0°, 3.5°, 4.0°, 4.5°, 5.0°, 6.0°, 7.0°, 8.0°, 9.0°, 10.0°, or any value therebetween. For example, the flow diversion angle may be greater than 0.5°. In another example, the flow diversion angle may be less than 10.0°. In yet other examples, the flow diversion angle may be any value in a range between 0.5° and 10.0°. In some embodiments, it may be critical that the flow diversion angle is less than 2.0° to reduce the wear on the flow diverter.

In some embodiments, the flow diverter extends past the uphole end of the housing of the reamer. In this manner, the flow diverter may extend into the downhole end of the tubular, sub, downhole tool, or other housing connected to the uphole end of the housing of the reamer.

In some embodiments, the reamer blocks may be located at the same longitudinal location on the reamer housing. This may reduce the length of the reamer. In some embodiments, the reamer blocks may be longitudinally offset. In other words, a downhole end of a first reamer block may be located uphole of an uphole end of a second reamer block, and a downhole end of the second reamer block may be located uphole of an uphole end of a third reamer block. In this embodiment, the central flow tube may be removed, and the reamer blocks may extend through the interior of the housing such that the inner wall is located past the longitudinal axis of the housing. This may further increase the exposure of the reamer. Fluid may flow through the reamer through the secondary flow tubes in the open space between circumferentially adjacent reamer blocks.

Referring now to the figures, FIG. 1 shows one example of a drilling system 100 for drilling an earth formation 101 to form a wellbore 102. The drilling system 100 includes a drill rig 103 used to turn a drilling tool assembly 104 which extends downward into the wellbore 102. The drilling tool assembly 104 may include a drill string 105, a bottomhole assembly ("BHA") 106, and a bit 110, attached to the downhole end of drill string 105.

The drill string 105 may include several joints of drill pipe 108 connected end-to-end through tool joints 109. The drill string 105 transmits drilling fluid through a central bore and transmits rotational power from the drill rig 103 to the BHA 106. In some embodiments, the drill string 105 may further include additional components such as subs, pup joints, etc. The drill pipe 108 provides a hydraulic passage through which drilling fluid is pumped from the surface. The drilling fluid discharges through selected-size nozzles, jets, or other orifices in the bit 110 for the purposes of cooling the bit 110 and cutting structures thereon, and for lifting cuttings out of the wellbore 102 as it is being drilled.

The BHA 106 may include the bit 110 or other components. An example BHA 106 may include additional or other components (e.g., coupled between to the drill string 105 and the bit 110). Examples of additional BHA components include drill collars, stabilizers, measurement-while-drilling ("MWD") tools, logging-while-drilling ("LWD") tools, downhole motors, underreamers, section mills, hydraulic disconnects, jars, vibration or dampening tools, other components, or combinations of the foregoing. The BHA 106 may further include a rotary steerable system (RSS). The RSS may include directional drilling tools that change a direction of the bit 110, and thereby the trajectory of the wellbore. At least a portion of the RSS may maintain a geostationary position relative to an absolute reference frame, such as gravity, magnetic north, and/or true north. Using measurements obtained with the geostationary position, the RSS may locate the bit 110, change the course of the bit 110, and direct the directional drilling tools on a projected trajectory.

In general, the drilling system 100 may include other drilling components and accessories, such as special valves (e.g., kelly cocks, blowout preventers, and safety valves). Additional components included in the drilling system 100 may be considered a part of the drilling tool assembly 104, the drill string 105, or a part of the BHA 106 depending on their locations in the drilling system 100.

The bit 110 in the BHA 106 may be any type of bit suitable for degrading downhole materials. For instance, the bit 110 may be a drill bit suitable for drilling the earth formation 101. Example types of drill bits used for drilling earth formations are fixed-cutter or drag bits. In other embodiments, the bit 110 may be a mill used for removing metal, composite, elastomer, other materials downhole, or combinations thereof. For instance, the bit 110 may be used with a whipstock to mill into casing 107 lining the wellbore 102. The bit 110 may also be a junk mill used to mill away tools, plugs, cement, other materials within the wellbore 102, or combinations thereof. Swarf or other cuttings formed by use of a mill may be lifted to surface, or may be allowed to fall downhole.

Figures 1, 2:
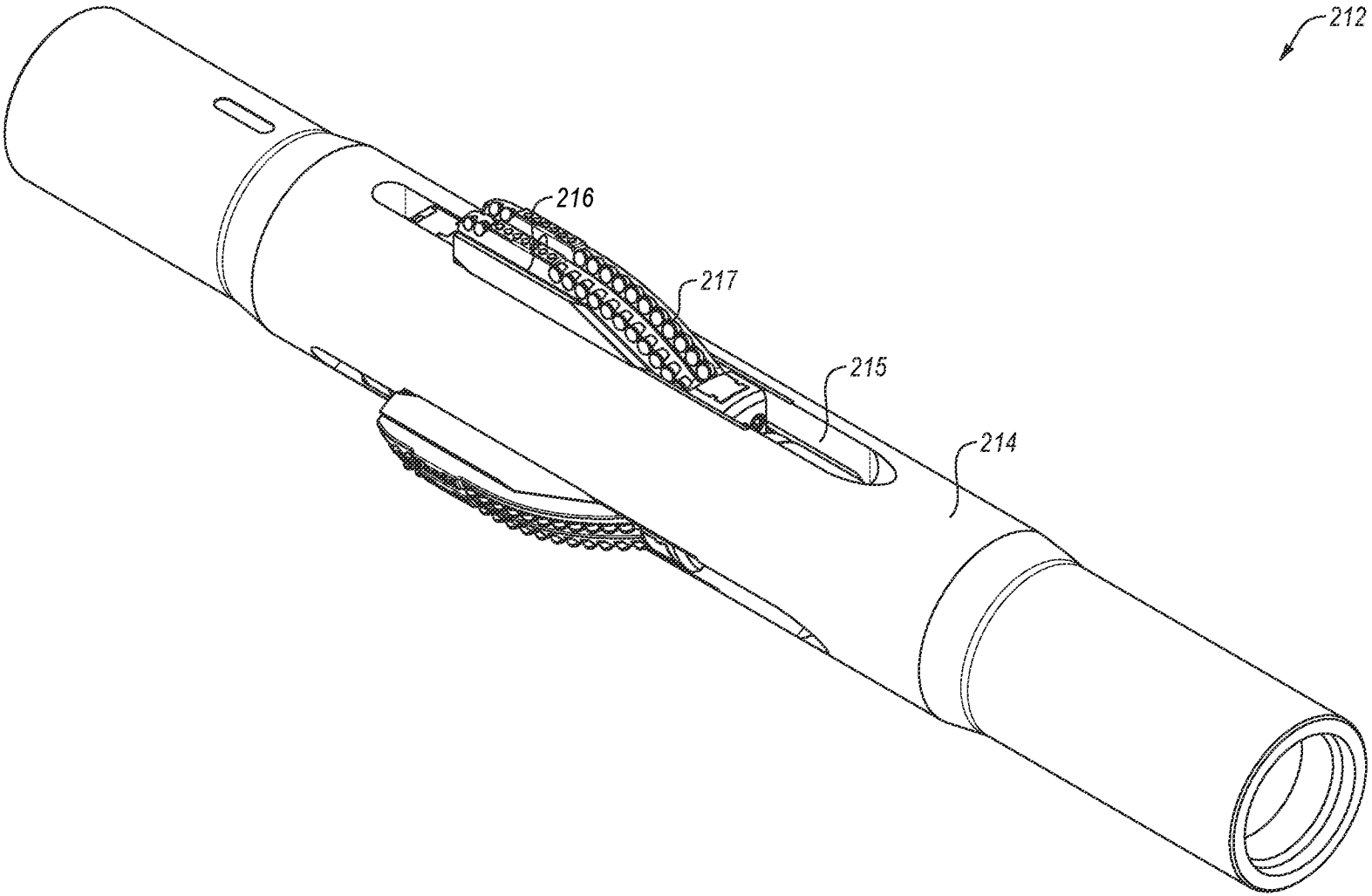
Figure 2:
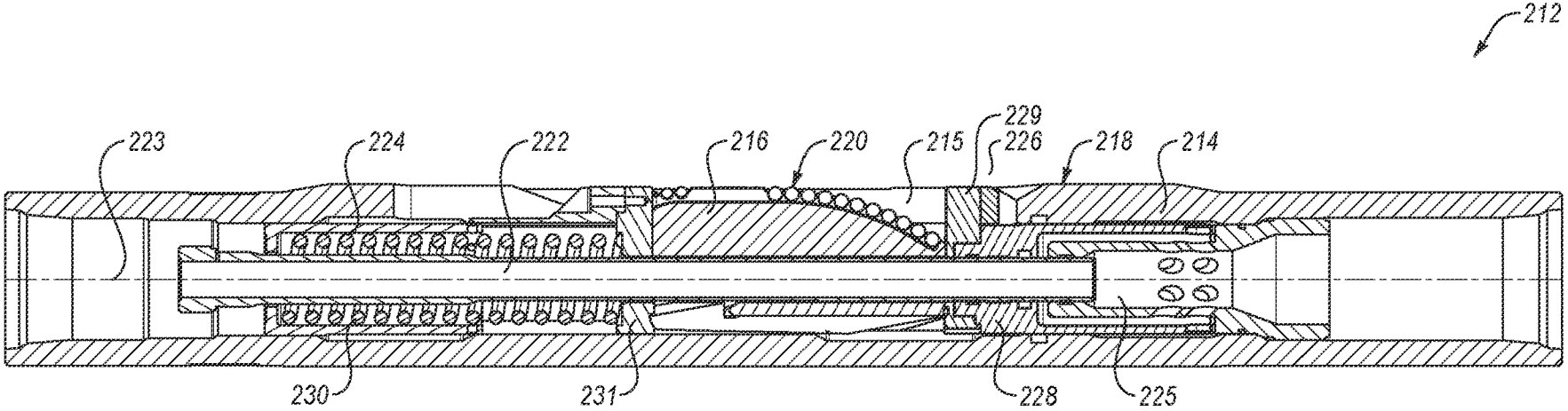

FIG. 2-1 is a perspective view of a reamer 212 in an expanded configuration, according to at least one embodiment of the present disclosure. The reamer 212 includes a housing 214. The housing 214 includes a plurality of openings 215. A reamer block 216 extends out of each opening 215. The reamer block 216 includes a plurality of cutting elements 217. Thus, as the reamer 212 is rotated, the cutting elements 217 may erode the wellbore wall, thereby expanding the diameter of the wellbore.

FIG. 2-2 is a transverse cross-sectional view of the reamer 212 of FIG. 2-1 in the retracted configuration, according to at least one embodiment of the present disclosure. In the retracted configuration, the reamer block 216 is retracted below an outer surface 218 of the housing 214. In other words, a radial perimeter 220 of the reamer block 216 is located radially inward of the outer surface 218 of the housing 215. Thus, the reamer 212 in the retracted configuration may not cut or engage the formation or casing, such as while the reamer 212 is being tripped into a wellbore.

The reamer 212 includes a flow tube 222 that may flow through a center of the interior 224 of the housing 214. The flow tube 222 may run through a longitudinal axis 223 of the housing 214. Fluid flow, such as drilling fluid, flows through the flow tube from left to right in the embodiment shown. The fluid flow may enter a piston chamber 225. A pressure differential between the piston chamber 225 and the exterior 226 of the housing 214 may exert an expansion force on a piston 228 in the piston chamber 225. The piston 228 may exerts the expansion force onto a lower plate 229, which may transfer the expansion force to the reamer block 216, thereby urging the reamer block 216 uphole. A resilient member 230 exerts a resilient force on an upper plate 231. The upper plate 231 transfers the resilient force to the reamer block 216, thereby urging the reamer block 216 downhole. In the retracted configuration shown in FIG. 2-2, the resilient force is greater than the expansion force, and therefore the reamer block 216 is located downhole in the retracted configuration.

Figures 2, 3:
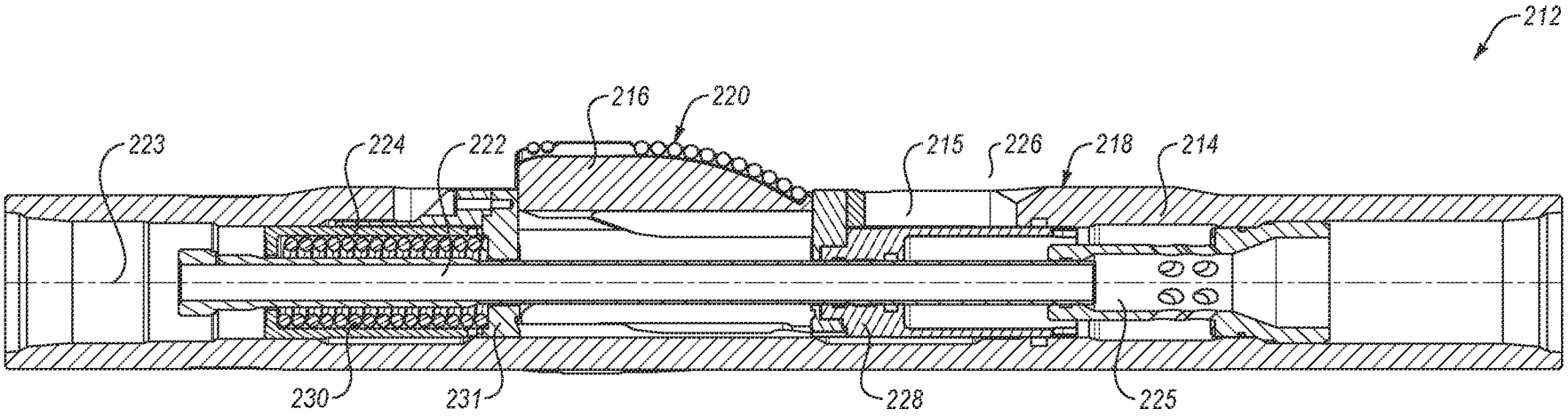

FIG. 2-3 is a transverse cross-sectional view of the reamer 212 of FIG. 2-1 in the expanded configuration, according to at least one embodiment of the present disclosure. In the expanded configuration, the radial perimeter 220 of the reamer block 216 is extended past the outer surface 218 of the housing 214. Thus, as the reamer 212 is rotated, the cutting elements on the reamer block 216 may engage and degrade the formation, thereby increasing the diameter of the wellbore.

To move between the retracted configuration shown in FIG. 2-2 to the expanded configuration shown in FIG. 2-3, the pressure differential between the piston chamber 225 and the exterior 226 of the housing 214 is increased, such as by increasing the volumetric flow rate of the fluid flow through the flow tube 222. This will increase the expansion force on the reamer block 216 by the piston 228 and lower plate 229. When the expansion force becomes greater than the resilient force on the upper plate 231 by the resilient member 230, the reamer block 216 may move uphole relative to the housing. One or more rails (e.g., splines) in the housing (not shown in FIG. 2-3) may direct the reamer block 216 radially outward as the reamer block 216 moves longitudinally uphole.

Figures 2, 3, 4:
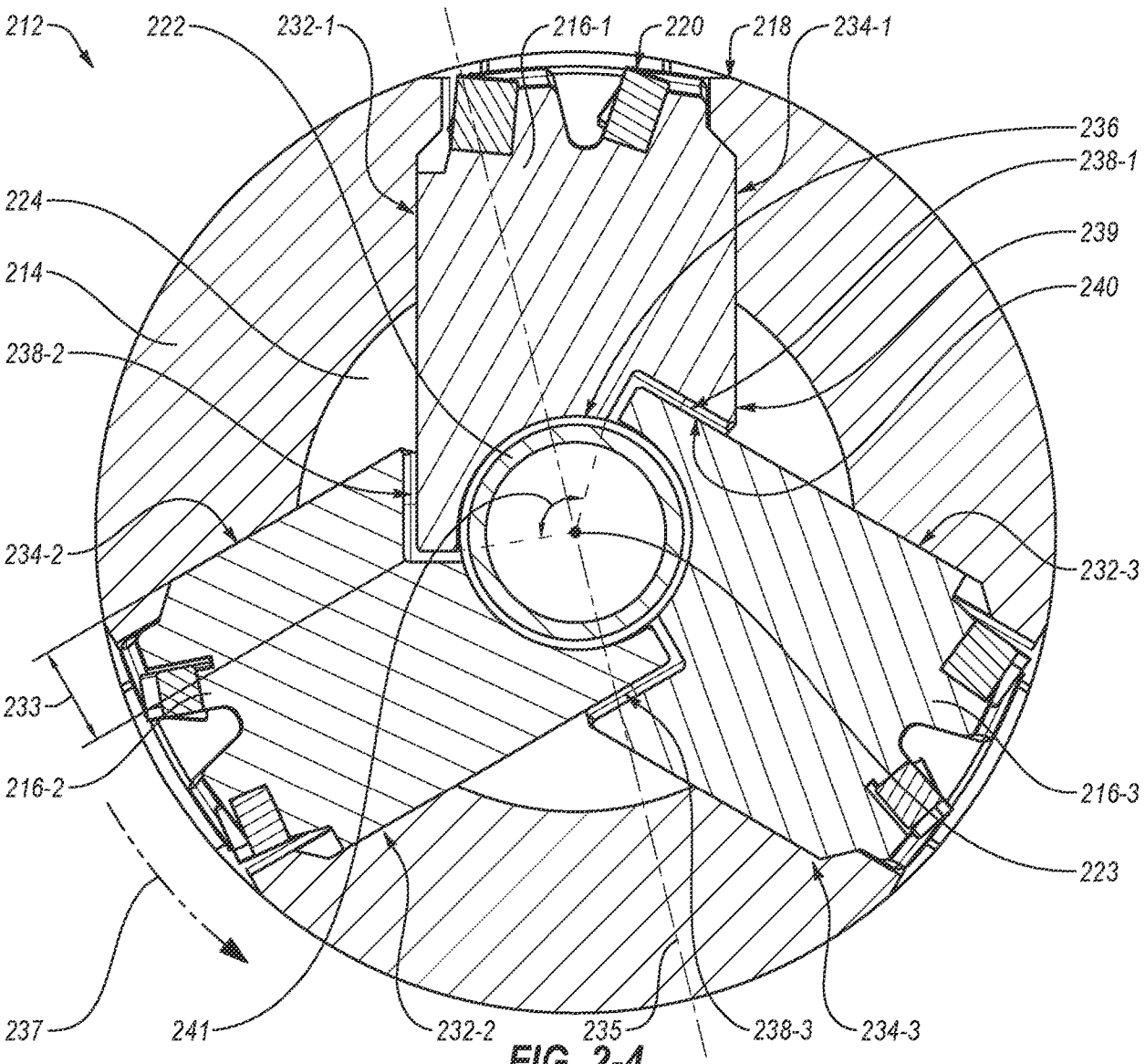

FIG. 2-4 is a transverse cross-sectional view of the reamer 212 of FIG. 2-3 in the retracted configuration, according to at least one embodiment of the present disclosure. In the embodiment shown, the reamer 212 includes three reamer blocks (collectively 216), a first reamer block 216-1, a second reamer block 216-2 circumferentially adjacent in the direction of rotation 237 to the first reamer block 216-1, and a third reamer block 216-3 circumferentially adjacent in the direction of rotation 237 to the second reamer block 216-2 and circumferentially adjacent opposite the direction of rotation 237 the first reamer block 216-1. The reamer blocks 216 have a radial perimeter 220, a leading wall (collectively 232), a trailing wall (collectively 234), and an inner wall (collectively 236). The leading wall 232 is the lateral wall of the reamer block 216 that first contacts the formation of a wellbore during rotation of the reamer 212. In other words, the leading wall 232 is the lateral wall of the reamer block that faces the direction of rotation 237 (clockwise in the view shown) of the reamer 212. The trailing wall 234 is the lateral wall of the reamer block 216 that contacts the formation of the wellbore last (if at all) during rotation of the wellbore. In other words, the trailing wall 234 is the lateral wall of the reamer block 216 that faces away from the direction of rotation 237.

The trailing wall 234 includes a recess (collectively 238). The recess 238 is located at the trailing inner edge 239 of the trailing wall 234. In other words, the recess 238 is located at the intersection between the trailing wall 234 and the inner wall 236. Thus, the inner wall 236 may be considered to include the recess 238. The recess 238 is shaped to receive a portion of the leading wall 232 of a circumferentially adjacent reamer block 216. In the retracted configuration shown in FIG. 2-4, the radial perimeter 220 of the reamer block 216 is located inside of the outer surface 218 of the housing 214. Thus, the first recess 238-1 receives the leading inner edge 240 of the third leading wall 232-3 such that the leading inner edge 240 of the third leading wall 232-3 is inserted (e.g., nested) in the first recess 238-1. This recess 238-1 may allow the third reamer block 216-3 to be retracted further into the interior 224 of the housing 214. As discussed below, the nesting relationships of the reamer blocks 216 may increase the exposure of the third reamer block 216-3 and decrease the coverage-to-exposure ratio.

Each of the first reamer block 216-1, the second reamer block 216-2, and the third reamer block 216-3 includes a recess 238. In some embodiments, the recess 238 may be a pocket, an opening, a notch, a receptacle, a cut-out, any other section, and combinations thereof. Thus, the reamer blocks 216 are all nested into each other. In other words, the leading wall 232 is inserted (e.g., nested) into the recess 238 of a circumferentially adjacent (in the direction of rotation 237) reamer block 216. Thus, the second reamer block 216-2 includes a second recess 238-2 in the second trailing wall 234-2 and the first leading wall 232-1 is inserted (e.g., nested) into the second recess 238-2. Similarly, the third reamer block 216-3 includes a third recess 238-3 in the third trailing wall 234-3 and the second leading wall 232-2 is inserted (e.g., nested) into the third recess 238-3. The first reamer block 216-3 includes a first recess 238-1 in the first trailing wall 234-1 and the third leading wall 232-3 is inserted (e.g., nested, at least partially enveloped, the leading inner edge 240 mating with the recess 238) into the third recess 238-3.

In the embodiment shown, the inner wall 236 of the reamer blocks is non-flat. For example, the inner wall 236 is partially complementary to the flow tube 222. The flow tube 222 is cylindrical, meaning that it has a circular cross-sectional shape. The inner wall 236 has a partially cylindrical surface, meaning that the inner wall 236 has a partially circular cross-sectional shape. In this manner, the inner wall 236 is at least partially complementary to the flow tube 222. Thus, in the retracted position shown in FIG. 2-4, the interior wall of the reamer block contacts or envelops a portion of the flow tube in the retracted position. In the embodiment shown in FIG. 2-4, the interior wall is concave, and the interior walls of all of the reamer blocks envelops (e.g., encompass, contact, cover) all or approximately (e.g., nearly) all of the outer circumference of the flow tube. In some embodiments, the inner wall 236 may be planar, and the inner wall 236 may extend at an angle from the trailing wall 234 to the leading wall 232.

The circular portion of the inner wall 236 is complementary to the flow tube for a wall arc angle 241. In some embodiments, the wall arc angle 241 may be in a range having an upper value, a lower value, or upper and lower values including any of 45°, 60°, 75°, 80°, 85°, 90°, 95°, 100°, 105°, 120°, or any value therebetween. For example, the wall arc angle 241 may be greater than 45°. In another example, the wall arc angle 241 may be less than 120°. In yet other examples, the wall arc angle 241 may be any value in a range between 45° and 120°. In some embodiments, it may be critical that the wall arc angle 241 is greater than 90° to nest the interior wall against the flow tube, increase the exposure, and decrease the coverage-to-exposure ratio.

The recess 238 has a recess depth 233 into the body of the reamer block 216. This may be visualized as the extent into which the leading wall 232 of the circumferentially adjacent reamer block 216 extends into the body of the reamer block 216. The recess depth 233 may be recess percentage of the width of the reamer block 216. In some embodiments, the recess percentage may be greater than 0%, greater than 5%, greater than 10%, greater than 15%, greater than 20%, greater than 25%, greater than 30%, greater than 35%, greater than 40%, greater than 45%, greater than 50%, or any value therebetween. In some embodiments, it may be critical that the recess percentage is greater than 10% to allow circumferentially adjacent reamer blocks 216 to nest with each other.

In the embodiment shown in FIG. 2-4, a line 235 drawn through the longitudinal axis 223 of the housing 214 and perpendicular to the longitudinal axis 223 contacts two or more of the reamer blocks 216 in the retracted configuration. In the embodiment shown, the line 235 contacts all three reamer blocks 216. The line contacts a first reamer block 216-1 in the body of the first reamer block 216-1, the second reamer block 216-2 in the inner edge of the second leading wall 232-2, and the third reamer block 216-3 in the third recess 238-3 of the third trailing wall 234-3. This is an indication of how far into the interior 224 of the housing 214 the reamer blocks 216 are retracted. In some embodiments, the reamer 212 may include any number of reamer blocks 216, including 2, 3, 4, 5, 6, 7, 8, 9, 10, or more reamer blocks.

FIG. 2-5 is a transverse cross-sectional view of the reamer 212 of FIG. 2-1 in the expanded configuration, according to at least one embodiment of the present disclosure. In the expanded configuration, the radial perimeter 220 of the reamer block 216 is extended past the outer surface 218 of the housing 214. The height that the radial perimeter 220 extends past the outer surface 218 is the exposure 242.

The reamer has a retracted diameter 243 and an expanded diameter 244. The retracted diameter 243 is the diameter of a retracted circle 245 circumscribed about the housing 214. The expanded diameter is the diameter of an expanded circle 246 circumscribed about the reamer blocks 216 in the expanded configuration. Thus, the exposure 242 is half of the difference between the expanded diameter and the retracted diameter, or the difference between the radius of the expanded circle 246 and the retracted circle 245.

The reamer ratio is the ratio between the expanded diameter and the retracted diameter. In some embodiments, the reamer ratio may be in a range having an upper value, a lower value, or upper and lower values including any of 2.5, 2.4, 2.3, 2.2, 2.1, 2.0, 1.9, 1.8, 1.7, 1.6, 1.5, 1.4, 1.3, 1.2, 1.1 or any value therebetween. For example, the reamer ratio may be greater than 1.1. In another example, the reamer ratio may be less than 2.5. In yet other examples, the reamer ratio may be any value in a range between 1.1 and 2.5. In some embodiments, it may be critical that the reamer ratio is greater than 2.0 to sufficiently expand the wellbore diameter.

During rotation, the radial perimeter 220 engages the formation (e.g., the wellbore wall). This exerts a reaming force on the reamer block 216 opposite the direction of rotation 237. The reaming force is countered by the side wall of the opening 215 in the housing 214 that contacts the trailing wall 234 (e.g., where the recess 238 is located). Because the reamer block 216 is extended past the outer surface 218 of the housing 214, the reaming force may urge the reamer block 216 to rotate. This may cause the leading wall 232 to push against the side wall of the opening 215 in the housing 214. The length of the contact between the leading wall 232 and the housing 214 is the coverage 248. Torque from the reaming force may be greater near the leading edge 240 of the reamer block 216 than a midpoint of the trailing wall 234 of the reamer block 216. Accordingly, the length of the leading wall 232 may be greater than the length of the trailing wall 234 of the reamer block 216.

A ratio of the coverage 248 to the exposure 242 is the coverage-to-exposure ratio. The coverage-to-exposure ratio is an indication of the maximum extension of the reamer. In some embodiments, the coverage-to-exposure ratio may be in a range having an upper value, a lower value, or upper and lower values including any of 0.50, 0.60, 0.70, 0.75, 0.80, 0.85, 0.90, 0.95, 1.00, 1.05, 1.1, 1.2, 1.3, 1.4, 1.5, 1.6, 1.7, 1.8, 1.9, 2.0, or any value therebetween. For example, the coverage-to-exposure ratio may be greater than 0.50. In another example, the coverage-to-exposure ratio may be less than 2.00. In yet other examples, the coverage-to-exposure ratio may be any value in a range between 0.50 and 2.00. In some embodiments, it may be critical that the coverage-to-exposure ratio is less than 1.00 to sufficiently increase the diameter of the wellbore. A lower coverage-to-exposure ratio is in indication that the reamer may have a larger increase in the diameter of the wellbore.

In some embodiments, the exposure 242 may be in a range having an upper value, a lower value, or upper and lower values including any of 1.5 in. (3.8 cm), 1.6 in. (4.1 cm), 1.7 in. (4.3 cm), 1.8 in. (4.6 cm), 1.9 in. (4.8 cm), 2.0 in. (5.1 cm), 2.1 in. (5.3 cm), 2.2 in. (5.6 cm), 2.3 in. (5.8 cm), 2.4 in. (6.1 cm), 2.5 in. (6.4 cm), 3.0 in. (7.62 cm), 4.0 in. (10.16 cm), 5.0 in. (12.7 cm), 6.0 in. (15.24 cm), 8.0 in. (20.32 cm), 10.0 in. (25.40 cm), 12.0 in. (30.48 cm), 15.0 in. (38.10 cm), 18.5 cm (46.99 cm), or any value therebetween. For example, the exposure 242 may be greater than 1.5 in (3.8 cm). In another example, the exposure 242 may be less than 18.5 in. (46.99 cm). In yet other examples, the exposure 242 may be any value in a range between 1.5 in (3.8 cm) and 18.5 in. (46.99 cm). In some embodiments, it may be critical that the exposure 242 be greater than 2.0 in. (5.1 cm) to sufficiently increase the diameter of the wellbore.

In some embodiments, the coverage 248 may be in a range having an upper value, a lower value, or upper and lower values including any of 1.0 in. (2.5 cm), 1.5 in. (3.8 cm), 1.6 in. (4.1 cm), 1.7 in. (4.3 cm), 1.8 in. (4.6 cm), 1.9 in. (4.8 cm), 2.0 in. (5.1 cm), 2.1 in. (5.3 cm), 2.2 in. (5.6 cm), 2.3 in. (5.8 cm), 2.4 in. (6.1 cm), 2.5 in. (6.4 cm), 3.0 in. (7.62 cm), 4.0 in. (10.16 cm), 5.0 in. (12.7 cm), 6.0 in. (15.24 cm), 8.0 in. (20.32 cm), 10.0 in. (25.40 cm), or any value therebetween. For example, the coverage 248 may be greater than 1.0 in. (2.5 cm). In another example, the coverage 248 may be less than 10.0 in. (25.4 cm). In yet other examples, the coverage 248 may be any value in a range between 1.0 in. (2.5 cm) and 10.0 in. (25.4 cm). In some embodiments, it may be critical that the coverage 248 be greater than 1.8 in. (4.6 cm) to provide support for the reamer block. Increased coverage 248 may result in greater stability for the reamer block. Furthermore, increased coverage 248 may increase the strength of reamer, thereby reducing the chance of the reamer block breaking during reaming operations.

The leading wall 232 of the reamer block 216 has a leading wall height 249 and the trailing wall 234 of the reamer block has a trailing wall height 250. The leading wall height 249 is the distance between the radial perimeter 220 and the inner wall 236 along the leading wall 232. The trailing wall height 250 is the distance between the radial perimeter 220 and the inner wall 236 along the trailing wall. In the embodiment shown in FIG. 2-5, the leading wall height 249 is greater than the trailing wall height 250. The ratio of the leading wall height to the trailing wall height is the wall-height ratio. In some embodiments, the wall-height ratio may be in a range having an upper value, a lower value, or upper and lower values including any of 1.0, 1.1, 1.2, 1.3, 1.4, 1.5, 1.6, 1.7, 1.8, 1.9, 2.0, 2.5, 3.0, or any value therebetween. For example, the wall-height ratio may be greater than 1.0. In another example, the wall-height ratio may be less than 3.0. In yet other examples, the wall-height ratio may be any value in a range between 1.0 and 3.0. In some embodiments, it may be critical that the wall-height ratio is greater than 1.2 to increase the coverage and exposure of the reamer block. Furthermore, a wall-height ratio greater than 1.2 may allow circumferentially adjacent reamer blocks to further nest into each other.

In the embodiment shown in FIG. 2-5, the leading wall height 249 may be greater than a radius of the housing 214. In other words, the leading wall height 249 may be greater than half of the retracted diameter of the retracted circle 245. The leading wall 232 has a height-to-retracted-diameter ratio. In some embodiments, the height-to-retracted-diameter ratio may be in a range having an upper value, a lower value, or upper and lower values including any of 0.45, 0.5, 0.55, 0.6, 0.65, 0.70, 0.75, or any value therebetween. For example, the height-to-retracted-diameter ratio may be greater than 0.45. In another example, the height-to-retracted-diameter ratio may be less than 0.075. In yet other examples, the height-to-retracted-diameter ratio may be any value in a range between 0.45 and 0.75. In some embodiments, it may be critical that the height-to-retracted-diameter ratio is greater than 0.5 to increase the exposure and decrease the coverage-to-exposure ratio.

The reamer block 216 has a reamer block transverse axis 252, which is the axis between the radial perimeter 220 and the inner wall 236. In the embodiment shown, the reamer block transverse axis 252 of the reamer blocks 216 extends through the longitudinal axis 223 of the housing 214. In some embodiments, the reamer block transverse axis 252 of one or more reamer blocks 216 may be offset from the longitudinal axis 223 of the housing 214. In some embodiments, the reamer block transverse axis 252 of one or more reamer blocks 216 may be offset from the longitudinal axis 223 of the housing in the direction of rotation 237 of the reamer 212. In some embodiments, the reamer block transverse axis 252 of one or more reamer blocks 216 may be offset from the longitudinal axis 223 of the housing 214 opposite the direction of rotation 237 of the reamer 212. Offsetting the reamer block transverse axis 252 may allow the reamer blocks 216 to nest deeper with respect to each other, thereby allowing the reamer blocks 216 to have an increased exposure 242 and/or a lower coverage-to-exposure ratio.

In some embodiments, the reamer block transverse axis 252 may be offset from the longitudinal axis of the reamer with an offset percentage, which is the length of the offset with respect to the diameter of the housing 214. In some embodiments, the offset percentage may be in a range having an upper value, a lower value, or upper and lower values including any of 1%, 2.5%, 5%, 7.5%, 10%, 12.5%, 15%, 20%, 25%, or any value therebetween. For example, the offset percentage may be greater than 1%. In another example, the offset percentage may be less than 25%. In yet other examples, the offset percentage may be any value in a range between 1% and 25%. In some embodiments it may be critical that the offset percentage is greater than 1% to increase the exposure 242 and/or decrease the coverage-to-exposure ratio.

FIG. 3 is a perspective view of a reamer block 316 looking at the inner surface 336, according to at least one embodiment of the present disclosure. The reamer block 316 includes a leading wall 332 and a trailing wall 334. The trailing wall 334 includes a recess 338, into with the leading wall 332 of a circumferentially adjacent reamer block 316 may be inserted or nested. In some embodiments, the leading wall 332 and/or the trailing wall 334 may include one or more splines that engage with an opening in a housing to help direct the reamer block 316 during expansion and to retain the reamer block 316 during operation. In the view shown, the inner surface 336 includes a curved portion 354 and a recess portion 356, with the recess portion 356 being a part of the recess 338. In the view shown, the recess 338 extends to an upper surface 358 of the reamer 316. The recess 338 does not extend all the way to the lower surface 360 of the reamer 316. In some embodiments, the recess 338 may extend all the way between the upper surface 358 and the lower surface 360. In other embodiments, the recess 338 begin and end between the upper surface 358 and the lower surface. By starting the recess 338 between the upper surface 358 and the lower surface 360, the upper wall 320 may extend all the way to the upper surface 358, thereby allowing more cutting elements to be placed on the upper wall 320.

FIG. 4-1 is a transverse cross-sectional view of a reamer 412 in the retracted configuration, according to at least one embodiment of the present disclosure. The reamer 412 includes a plurality of reamer blocks (collectively 416). A primary flow tube 422 extends through a center of the housing 414. A plurality of secondary flow tubes (collectively 462) extend through the interior 424 of the housing radially outward of the primary flow tube 422. The secondary flow tubes 462 are located between circumferentially adjacent reamer blocks 416 and next to the inner wall of the housing 414. In other words, a first secondary flow tube 462-1 is located between the first leading wall 432-1 of the first reamer block 416-1 and the second trailing wall 434-2 of the second reamer block. A second secondary flow tube 462-2 is located between the second leading wall 432-2 of the second reamer block 416-2 and the third trailing wall 434-3 of the third reamer block 416-3. A third secondary flow tube 462-3 is located between the third leading wall 432-3 of the third reamer block 416-3 and the first trailing wall 434-1 of the first reamer block 416-1. The secondary flow tubes 462 may allow for a higher volumetric flow rate of drilling fluid to pass through the housing 414 for the same drilling pressure. This may allow more downhole tools to be used while the reamer 412 is being used, thereby increasing the versatility of the reamer 412.

FIG. 4-2 is a longitudinal cross-sectional view of the reamer 412 of FIG. 4-1 in the retracted configuration, according to at least one embodiment of the present disclosure. In the embodiment shown, a resilient member 430 is shown as around the secondary flow tube 462. The resilient member 430 pushes against the upper plate 431 to resist extension of the reamer block 416. In the embodiment shown, three resilient members 430 are located around three secondary flow tubes 462. This may allow for a sufficient resilient force against the upper plate 431. The resilient members 430 shown are coil springs.

A flow diverter 464 directs flow to the primary flow tube 422 and the secondary flow tubes 462. An uphole end of the flow diverter 464 extends uphole of the reamer block 416. This may allow the flow diverter 464 to have a reduced flow diversion angle 466. A low flow diversion angle 466 may reduce wear on the flow diverter 464 from high velocity fluid flow and particulates in the fluid flow. In some embodiments, the flow diversion angle 466 may be in a range having an upper value, a lower value, or upper and lower values including any of 0.5°, 1.0°, 1.5°, 2.0°, 2.5°, 3.0°, 3.5°, 4.0°, 4.5°, 5.0°, 6.0°, 7.0°, 8.0°, 9.0°, 10.0°, or any value therebetween. For example, the flow diversion angle 466 may be greater than 0.5°. In another example, the flow diversion angle 466 may be less than 10.0°. In yet other examples, the flow diversion angle 466 may be any value in a range between 0.5° and 10.0°. In some embodiments, it may be critical that the flow diversion angle 466 is less than 2.0° to reduce the wear on the flow diverter. In the embodiment shown, the flow diverter 464 extends past the uphole end of the reamer 412. In this manner, the flow diverter 464 may extend into the downhole end of the tubular, sub, downhole tool, or other housing connected to the uphole end of the housing of the reamer.

Figures 2, 3, 4, 5:
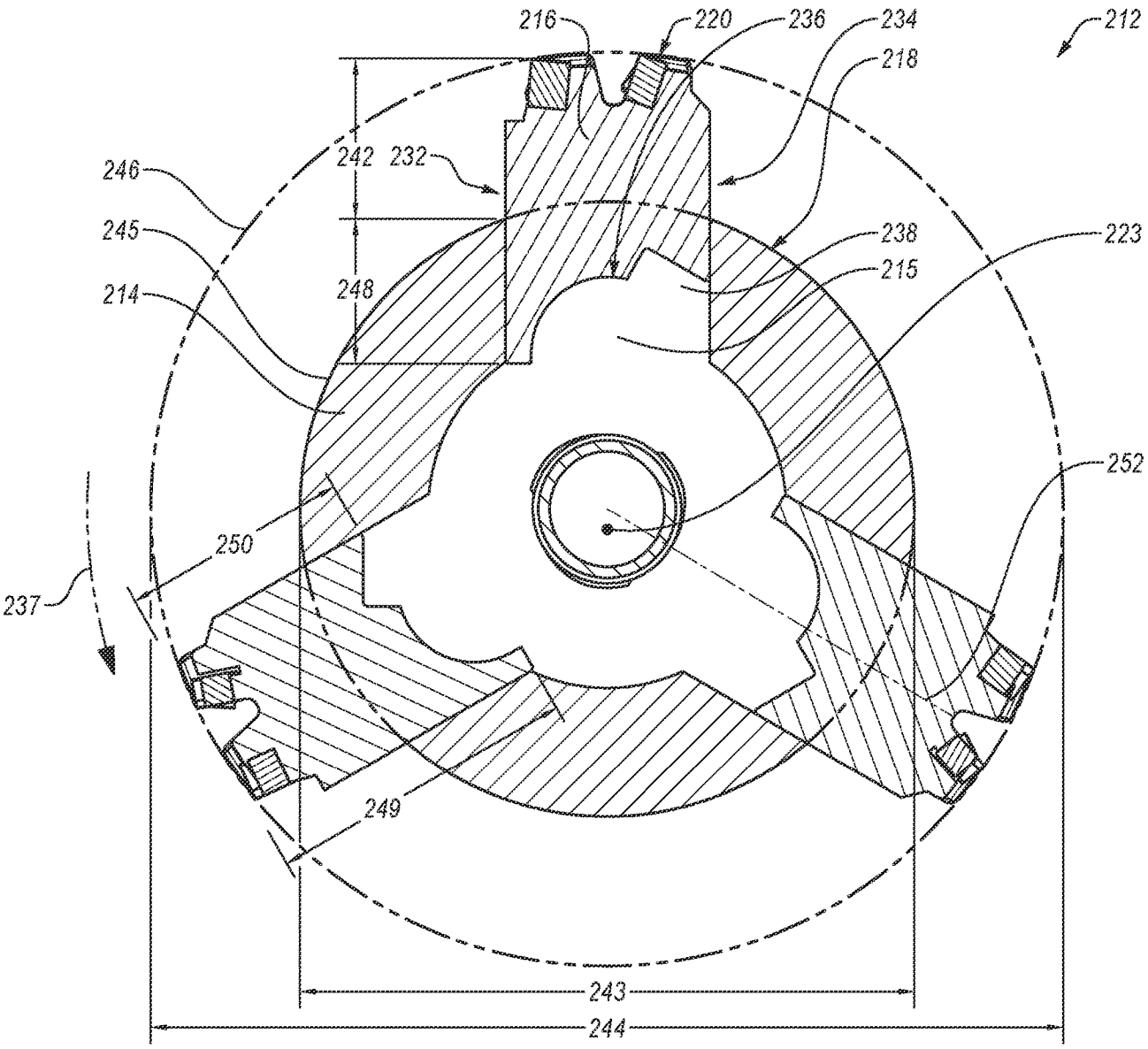
Figure 3:
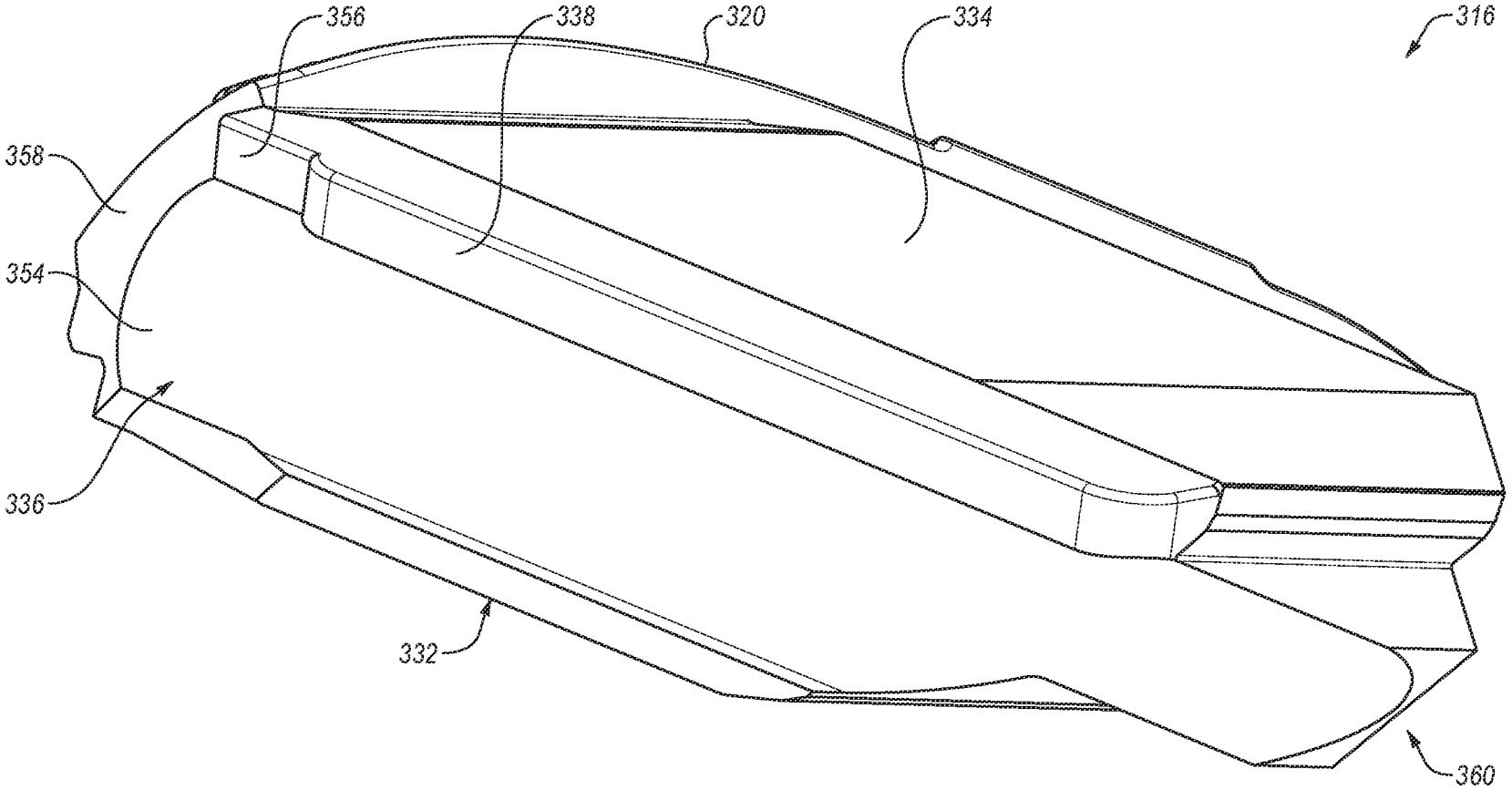
Figures 1, 4:
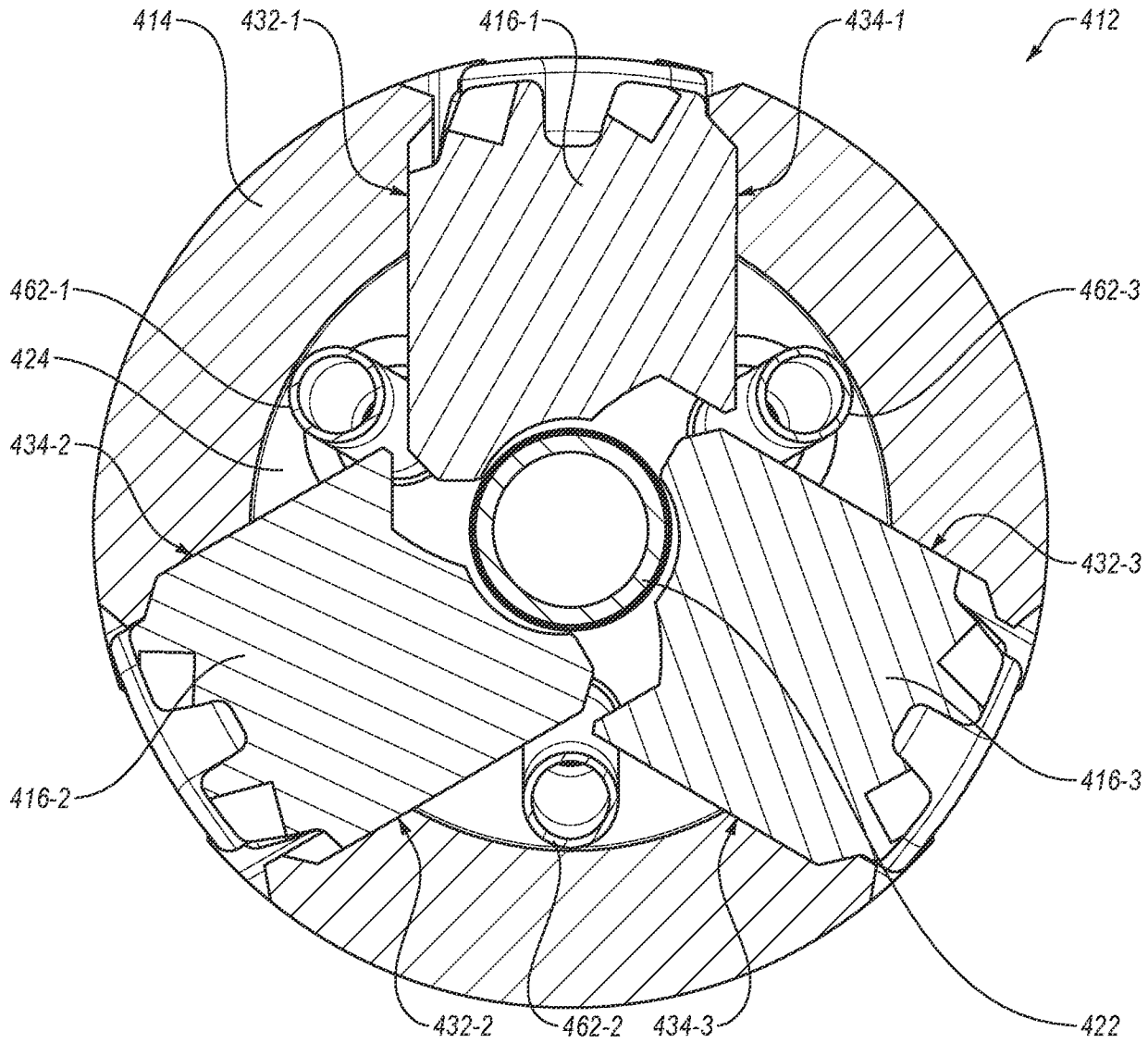
Figures 2, 4:
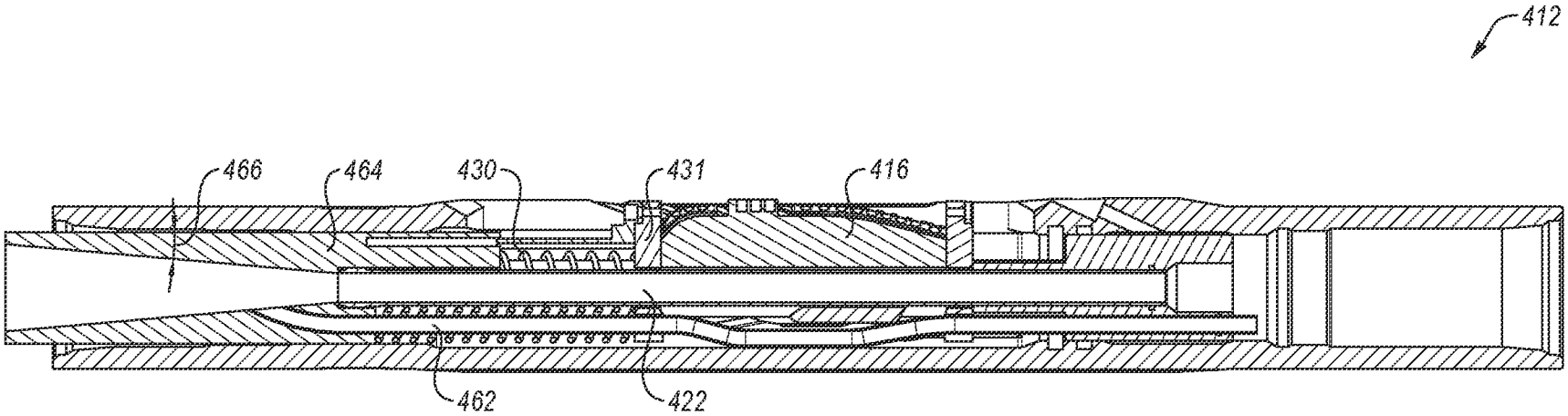
Figure 5:
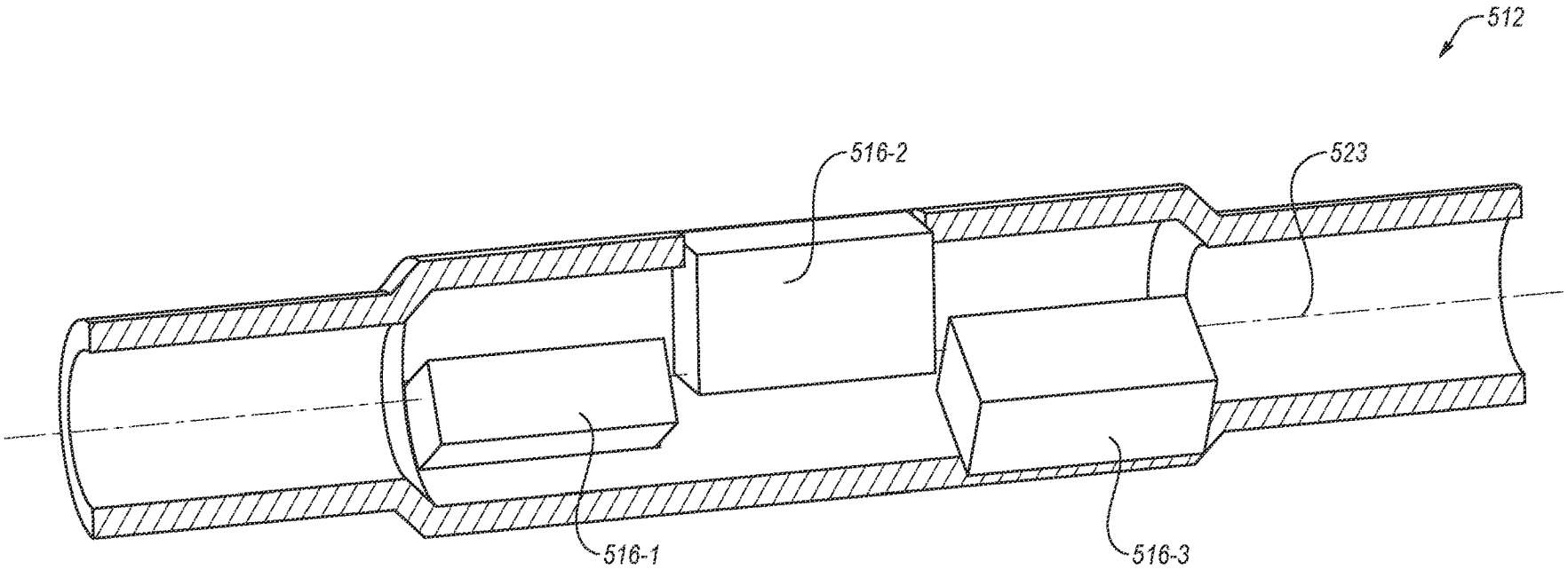

FIG. 5 is a cut-away view of a reamer 512 in the retracted configuration, according to at least one embodiment of the present disclosure. In the embodiment shown, the reamer blocks (collectively 516) are longitudinally offset. In other words, a downhole end of a first reamer block 516-1 is located uphole of an uphole end of a second reamer block 516-2, and a downhole end of the second reamer block 516-2 may be located uphole of an uphole end of a third reamer block 516-3. In this embodiment, the primary flow tube (e.g. primary flow tube 422 of FIG. 4-1) may be removed, and the reamer blocks 516 may extend through the interior of the housing such that one or more of the inner walls extends radially across the longitudinal axis 523 of the housing. This may further increase the exposure of the reamer. Fluid may flow through the reamer through the secondary flow tubes (e.g., secondary flow tubes 462 of FIG. 4-1) in between circumferentially adjacent and longitudinally offset reamer blocks 516.

The embodiments of the high-ratio reamer have been primarily described with reference to wellbore drilling operations; the high-ratio reamer described herein may be used in applications other than the drilling of a wellbore. In other embodiments, high-ratio reamer according to the present disclosure may be used outside a wellbore or other downhole environment used for the exploration or production of natural resources. For instance, high-ratio reamer of the present disclosure may be used in a borehole used for placement of utility lines. Accordingly, the terms "wellbore," "borehole" and the like should not be interpreted to limit tools, systems, assemblies, or methods of the present disclosure to any particular industry, field, or environment.

One or more specific embodiments of the present disclosure are described herein. These described embodiments are examples of the presently disclosed techniques. Additionally, in an effort to provide a concise description of these embodiments, not all features of an actual embodiment may be described in the specification. It should be appreciated that in the development of any such actual implementation, as in any engineering or design project, numerous embodiment-specific decisions will be made to achieve the developers' specific goals, such as compliance with system-related and business-related constraints, which may vary from one embodiment to another. Moreover, it should be appreciated that such a development effort might be complex and time consuming, but would nevertheless be a routine undertaking of design, fabrication, and manufacture for those of ordinary skill having the benefit of this disclosure.

Additionally, it should be understood that references to "one embodiment" or "an embodiment" of the present disclosure are not intended to be interpreted as excluding the existence of additional embodiments that also incorporate the recited features. For example, any element described in relation to an embodiment herein may be combinable with any element of any other embodiment described herein. Numbers, percentages, ratios, or other values stated herein are intended to include that value, and also other values that are "about" or "approximately" the stated value, as would be appreciated by one of ordinary skill in the art encompassed by embodiments of the present disclosure. A stated value should therefore be interpreted broadly enough to encompass values that are at least close enough to the stated value to perform a desired function or achieve a desired result. The stated values include at least the variation to be expected in a suitable manufacturing or production process, and may include values that are within 5%, within 1%, within 0.1%, or within 0.01% of a stated value.

A person having ordinary skill in the art should realize in view of the present disclosure that equivalent constructions do not depart from the spirit and scope of the present disclosure, and that various changes, substitutions, and alterations may be made to embodiments disclosed herein without departing from the spirit and scope of the present disclosure. Equivalent constructions, including functional "means-plus-function" clauses are intended to cover the structures described herein as performing the recited function, including both structural equivalents that operate in the same manner, and equivalent structures that provide the same function. It is the express intention of the applicant not to invoke means-plus-function or other functional claiming for any claim except for those in which the words 'means for' appear together with an associated function. Each addition, deletion, and modification to the embodiments that falls within the meaning and scope of the claims is to be embraced by the claims.

The terms "approximately," "about," and "substantially" as used herein represent an amount close to the stated amount that is within standard manufacturing or process tolerances, or which still performs a desired function or achieves a desired result. For example, the terms "approximately," "about," and "substantially" may refer to an amount that is within less than 5% of, within less than 1% of, within less than 0.1% of, and within less than 0.01% of a stated amount. Further, it should be understood that any directions or reference frames in the preceding description are merely relative directions or movements. For example, any references to "up" and "down" or "above" or "below" are merely descriptive of the relative position or movement of the related elements.

The present disclosure may be embodied in other specific forms without departing from its spirit or characteristics. The described embodiments are to be considered as illustrative and not restrictive. The scope of the disclosure is, therefore, indicated by the appended claims rather than by the foregoing description. Changes that come within the meaning and range of equivalency of the claims are to be embraced within their scope.

What is claimed is:

1. A reamer, comprising:

a housing having a longitudinal axis;

a flow tube extending along the longitudinal axis of the housing;

a plurality of reamer blocks arranged radially around the flow tube and configured to extend and retract relative to the housing, wherein a reamer ratio is between 1.8 and 2.5, and the reamer ratio is a ratio between an expanded diameter of the reamer when the plurality of reamer blocks is extended and a retracted diameter of the reamer when the plurality of reamer blocks is retracted; and a flow diverter configured to direct a flow to the flow tube, wherein the flow diverter comprises a diversion angle between 0.5 to 10 degrees, and the flow diverter extends longitudinally past an uphole end of the reamer.

2. The reamer of claim 1, wherein the housing comprises an opening corresponding to each reamer block of the plurality of reamer blocks, wherein each reamer block comprises splines configured to engage with the corresponding opening of the housing.

3. The reamer of claim 2, wherein each reamer block is configured to extend longitudinally and radially via the splines to the expanded diameter, and to retract longitudinally and radially via the splines to the retracted diameter.

4. The reamer of claim 2, wherein an exposure is a distance from an outer surface of the housing and a coverage is a length of a contact of a leading wall of a reamer block with the corresponding opening of the housing, wherein a coverage-to-exposure ratio is less than or equal to 1.00.

5. The reamer of claim 1, wherein each reamer block of the plurality of reamer blocks comprises a concave interior wall.

6. The reamer of claim 1, wherein the reamer ratio is between 2.0 and 2.5.

7. The reamer of claim 1, wherein each reamer block of the plurality of reamer blocks comprises a block transverse axis offset from the longitudinal axis.

8. The reamer of claim 1, wherein each reamer block of the plurality of reamer blocks comprises a leading wall between a radial perimeter and an inner wall, and a trailing wall between the radial perimeter and the inner wall, wherein a wall-height ratio is between 1.2 and 3.0, and the wall-height ratio comprises a ratio between a height of the leading wall and a height of the trailing wall.

9. The reamer of claim 1, wherein each reamer block of the plurality of reamer blocks comprises:

a leading wall between a radial perimeter and an inner wall;

a trailing wall between the radial perimeter and the inner wall; and a recess at an intersection between the trailing wall and the inner wall, wherein the recess comprises a depth between 10% to 50% of a width of the respective reamer block, and the leading wall of each reamer block is configured to nest into a recess of another reamer block in the retracted configuration.

10. The reamer of claim 1, wherein each reamer block comprises a height, and a height-to-retracted-diameter ratio is between 0.55 to 0.75.

11. The reamer of claim 1, comprising a secondary flow tube within an interior passage of the housing and radially outward from the flow tube, wherein the flow diverter is configured to direct the flow to the flow tube and the secondary flow tube.

12. A reamer, comprising:

a housing having a longitudinal axis;

a flow tube extending along the longitudinal axis of the housing; and a plurality of reamer blocks arranged radially around the flow tube and configured to extend and retract relative to the housing, wherein a reamer ratio is between 1.8 and 2.5, and the reamer ratio is a ratio between an expanded diameter of the reamer when the plurality of reamer blocks is extended and a retracted diameter of the reamer when the plurality of reamer blocks is retracted, wherein a first reamer block of the plurality of reamer blocks is uphole of a second reamer block of the plurality of reamer blocks, and the second reamer block is uphole of a third reamer block of the plurality of reamer blocks.

13. A reamer, comprising:

a housing comprising an exterior;

a reamer block, the reamer block comprising:

a leading wall, wherein a height of the leading wall is greater than a radius of the housing;

a trailing wall, wherein a wall-height ratio is between 1.4 and 3.0, and the wall-height ratio comprises a ratio between the height of the leading wall and a height of the trailing wall;

a radial perimeter;

a flow tube extending through the interior of the housing, wherein the reamer block is disposed radially outside the flow tube; and a flow diverter configured to direct a flow to the flow tube, wherein the flow diverter comprises a diversion angle between 0.5 to 10 degrees, and the flow diverter extends longitudinally past an uphole end of the reamer.

14. The reamer of claim 13, wherein a reamer ratio is greater than 2.00.

15. The reamer of claim 13, wherein the reamer block is a first reamer block, the leading wall is a first leading wall, and wherein the first reamer block includes a recess in a trailing wall of the first reamer block, and comprising a second reamer block including a second leading wall, the second leading wall being nested into the recess.

16. The reamer of claim 13, wherein the reamer block comprises a block transverse axis offset from a longitudinal axis of the housing.

17. The reamer of claim 12, wherein the housing comprises an opening corresponding to each reamer block of the plurality of reamer blocks, wherein each reamer block comprises splines configured to engage with the corresponding opening of the housing.

18. The reamer of claim 17, wherein each reamer block is configured to extend longitudinally and radially via the splines to the expanded diameter, and to retract longitudinally and radially via the splines to the retracted diameter.

19. The reamer of claim 17, wherein an exposure is a distance from an outer surface of the housing and a coverage is a length of a contact of a leading wall of a reamer block with the corresponding opening of the housing, wherein a coverage-to-exposure ratio is less than or equal to 1.00.

* * * * *